US009132558B2

(12) United States Patent
Millhouse

(10) Patent No.: US 9,132,558 B2
(45) Date of Patent: Sep. 15, 2015

(54) FOLDING BLADE KNIFE WITH FLEXIBLE TENDON AND TENSION SPRING ACTUATION

(71) Applicant: Allen Millhouse, Mt. Morris, IL (US)

(72) Inventor: Allen Millhouse, Mt. Morris, IL (US)

( * ) Notice: Subject to any disclaimer, the term of this patent is extended or adjusted under 35 U.S.C. 154(b) by 26 days.

(21) Appl. No.: 13/969,577

(22) Filed: Aug. 18, 2013

(65) Prior Publication Data

US 2015/0047206 A1 Feb. 19, 2015

(51) Int. Cl.
*B26B 1/02* (2006.01)
*B26B 1/04* (2006.01)

(52) U.S. Cl.
CPC ..... *B26B 1/048* (2013.01)

(58) Field of Classification Search
USPC ..... 30/158–160, 155–157, 330
See application file for complete search history.

(56) References Cited

U.S. PATENT DOCUMENTS

| | | | | |
|---|---|---|---|---|
| 199,766 | A | 1/1878 | Waldron et al. | |
| 551,052 | A | 12/1895 | Whitehouse | |
| 557,760 | A | 4/1896 | Brauer | |
| 698,080 | A * | 4/1902 | Treas | 30/159 |
| 1,603,914 | A * | 10/1926 | Hermann | 30/157 |
| 5,815,927 | A * | 10/1998 | Collins | 30/161 |
| 6,079,106 | A * | 6/2000 | Vallotton | 30/161 |
| 6,145,202 | A * | 11/2000 | Onion | 30/160 |
| 6,397,477 | B1 * | 6/2002 | Collins | 30/161 |
| 7,246,441 | B1 * | 7/2007 | Collins | 30/160 |
| 7,395,599 | B2 | 7/2008 | Onion | |
| 7,578,064 | B2 * | 8/2009 | Busse | 30/153 |

* cited by examiner

*Primary Examiner* — Sarah B McPartlin

(57) ABSTRACT

A folding knife with a handle and blade connected at a axle pin, with a tension spring within the handle pinned to the handle on one end and pinned to a flexible tendon in the form of a chain on the opposite end. The flexible tendon in the form of a chain is pinned at opposite ends to the spring and the blade at a distance from the blade axle pin. When the blade is folded about the axle pin energy is stored in the tension spring by force transferring from the blade through the flexible tendon in the form of a chain to the spring. When the blade is folded a catch blocks the blade from unfolding, and when the user actuates this blocking catch the stored energy in the tension spring is released thus causing the blade to rotate about the axis point and deploy to the opened position.

1 Claim, 6 Drawing Sheets

FOLDING BLADE KNIFE WITH FLEXIBLE TENDON AND TENSION SPRING ACTUATION

CROSS-REFERENCE TO RELATED APPLICATIONS

61/710,777

STATEMENT REGARDING FEDERALLY SPONSORED RESEARCH OR DEVELOPMENT

NOT APPLICABLE

THE NAMES OF THE PARTIES TO A JOINT RESEARCH AGREEMENT

NOT APPLICABLE

INCORPORATIONS-BY-REFERENCE OF MATERIAL SUBMITTED ON A COMPACT DISC OR AS A TEXT FILE VIA THE OFFICE ELECTRONIC FILING SYSTEM (EFS-WEB)

NOT APPLICABLE

STATEMENT REGARDING PRIOR DISCLOSURES BY THE INVENTOR OR A JOINT INVENTOR

NOT APPLICABLE

BACKGROUND OF THE INVENTION

Folding knives can be actuated by various methods of externally applied or internally stored energy. Externally powered folding knives function by the user applying force to actuate the deployment of the blade around an axle pin to its full extended position. Internally powered folding knives use energy stored in a spring mechanism, and typically a catch, button, or stud is pressed which allows the blade to rotate about the axle pin and deploy. In addition to these two methods, a more recent development is the hybrid power system which is often known as the "spring assist" design. This design uses an initial externally powered force by the used, typically on a projection on the side of the blade, to start the deployment of the blade. At a certain point in the rotation about the axle pin the spring overcomes an internal stud or projection that provides resistance, and once past that projection the spring force is applied to the blade and fully deploys the blade without any further force applied externally by the user.

In both the internally powered folding knife and the "spring assist" folding knife the blade is powered by a torsion spring. The size and weight of the blade is limited by the power of the torsion spring that can fit in the area near the blade axis point, and the torsion spring itself, and thus its power, is limited by the physical area inside the handle. The geometry of internalizing this torsion spring thus limits the assembly to a defined envelope of blade size, weight, and length compared to the size of the handle.

By moving the spring location to a different location in the handle, and by changing the spring from a torsion type spring to a tension type spring it is possible to increase the limits of blade size, weight, and length without changing the handle size. Connecting the blade to the tension spring allows the function of the mechanism while keeping the tension spring completely internalized and thus protecting this part from damage, abuse, and from the external environment. The use of a tendon also allows a longer distance for the spring to act upon the blade, thus allowing more energy to be applied to the blade overall.

BRIEF SUMMARY OF THE INVENTION

In accordance with one embodiment a tension spring contained within the handle of a folding knife is pinned on one end to the handle, and attached to a tendon on the opposite end of the spring. The tendon is attached to the outside edge of the blade, and the blade is pinned at an axle pin. The distance between the axle pin of the blade and the location of the pinned tendon provides a moment arm which is acted upon by the tension spring when the user of the knife applies force to a release mechanism that keeps the blade folded.

DRAWINGS

Reference Numerals

Figure 1A:
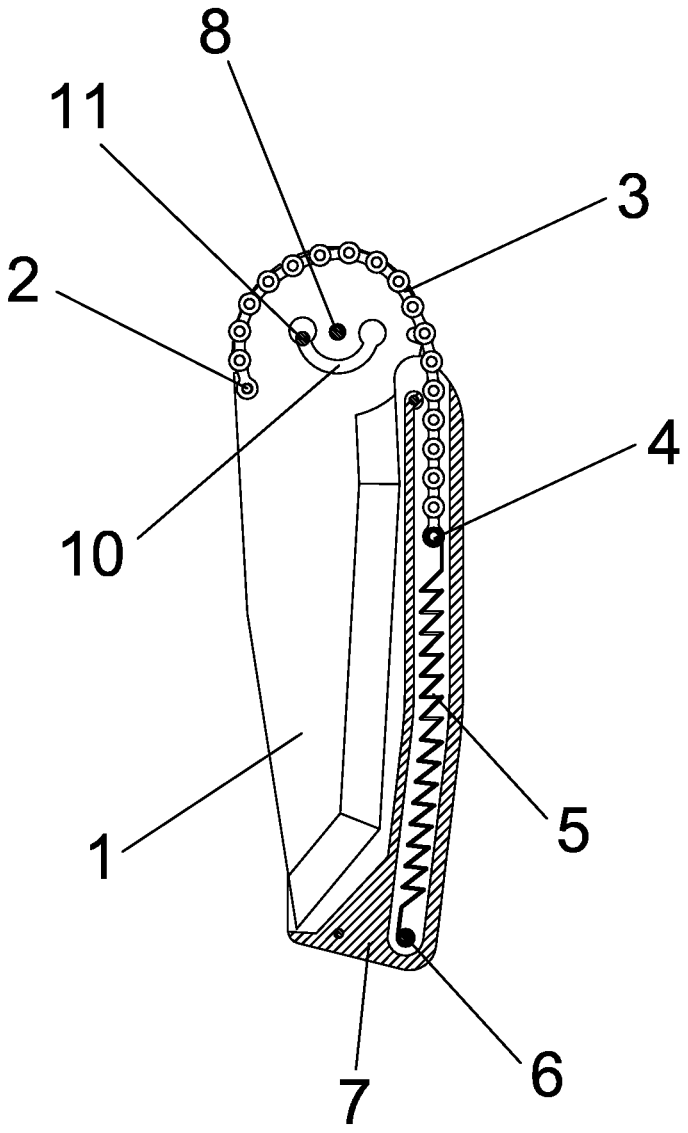
FIG. 1A is an elevation of the left side of the knife with the blade folded and with the left side grip panel and locking mechanism removed for clarity.

1 knife blade
2 blade to tendon connection pin
3 flexible tendon
4 tendon to tension spring connection pin
5 tension spring
6 tension spring to handle connection pin
7 right side of knife handle
8 axle pin
9 blade release catch
10 radial slot in blade
11 blade rotation stop pin
12 blade release catch spring
13 left side of knife handle

DETAILED DESCRIPTION OF THE INVENTION

FIGS. 1A, 1B, 1C, 1D, 1E, and 1F

First Embodiment

Figure 1B:
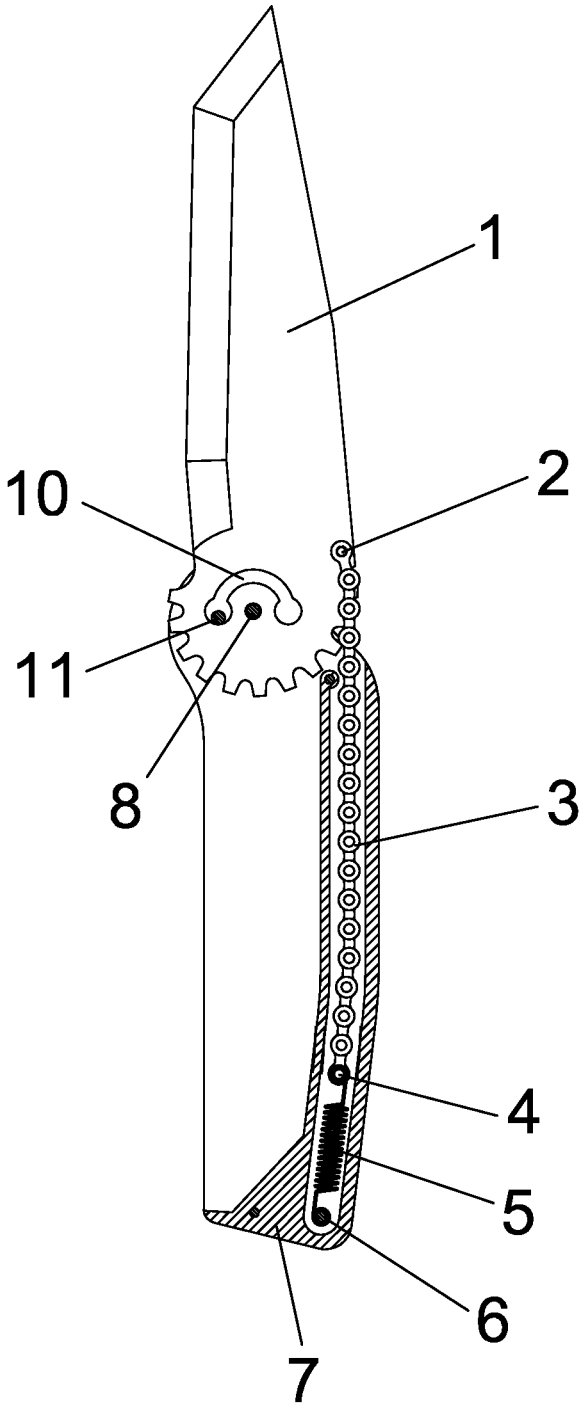
FIG. 1B is an elevation of the left side of the knife with the blade deployed in the extended position and with the left side grip panel and locking mechanism removed for clarity.
Figure 1C:
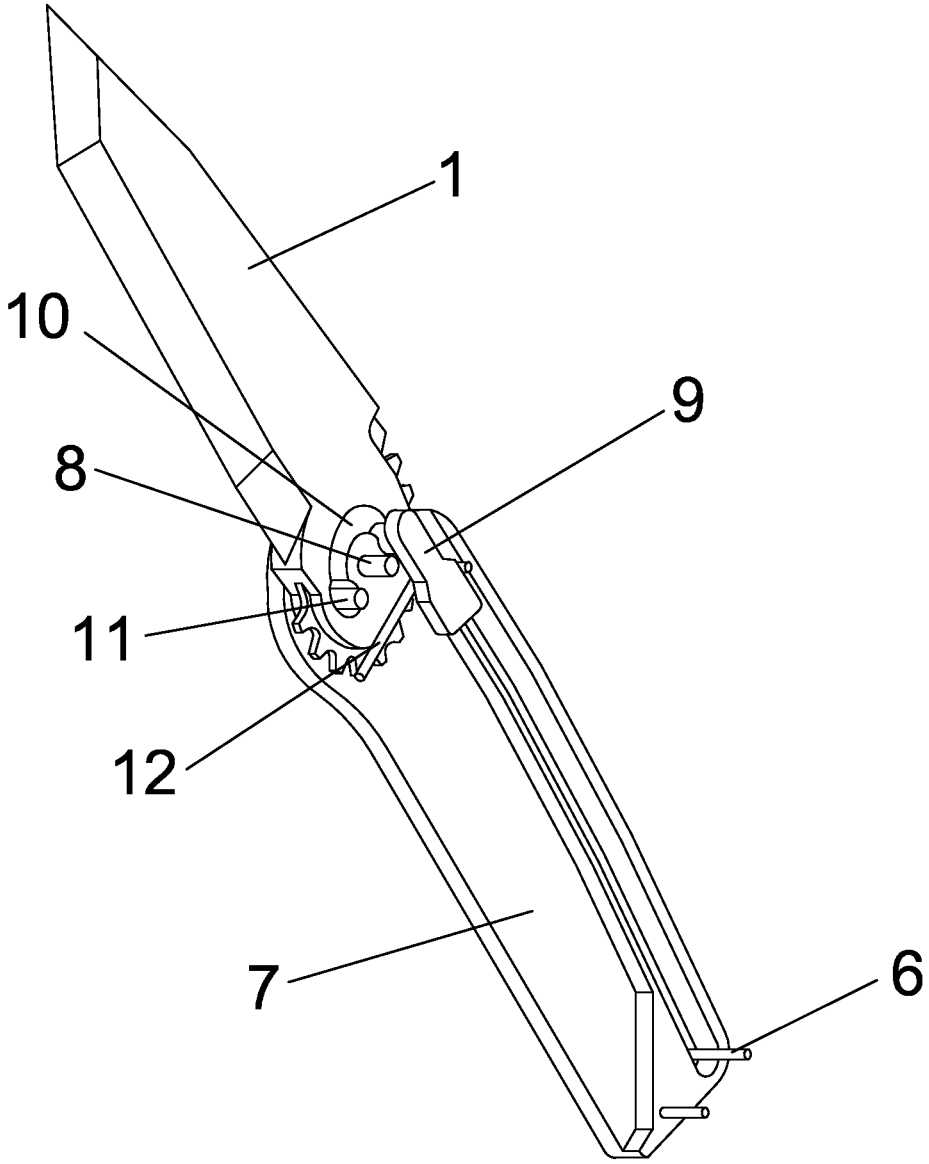
FIG. 1C is a perspective of the knife with the left side grip panel, tendon, and spring removed for clarity.
Figure 1D:
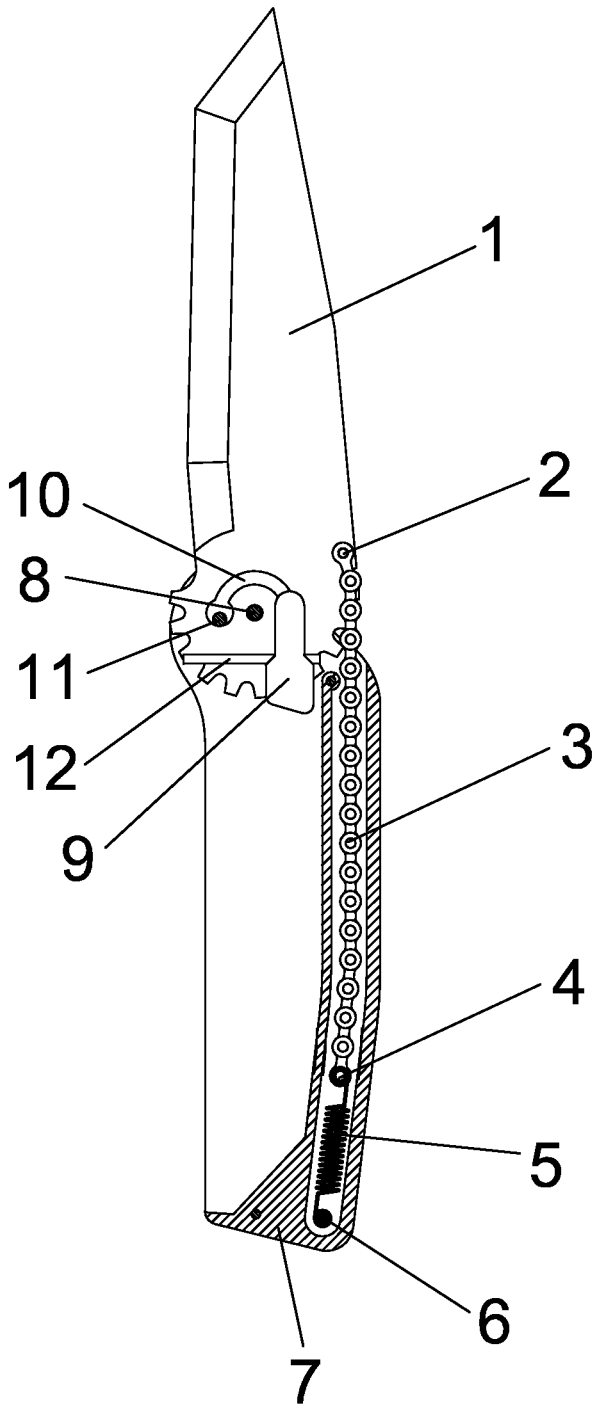
FIG. 1D is an elevation of the left side of the knife with the blade deployed in the extended position and the left side grip panel, tendon, and spring removed for clarity.
Figure 1E:
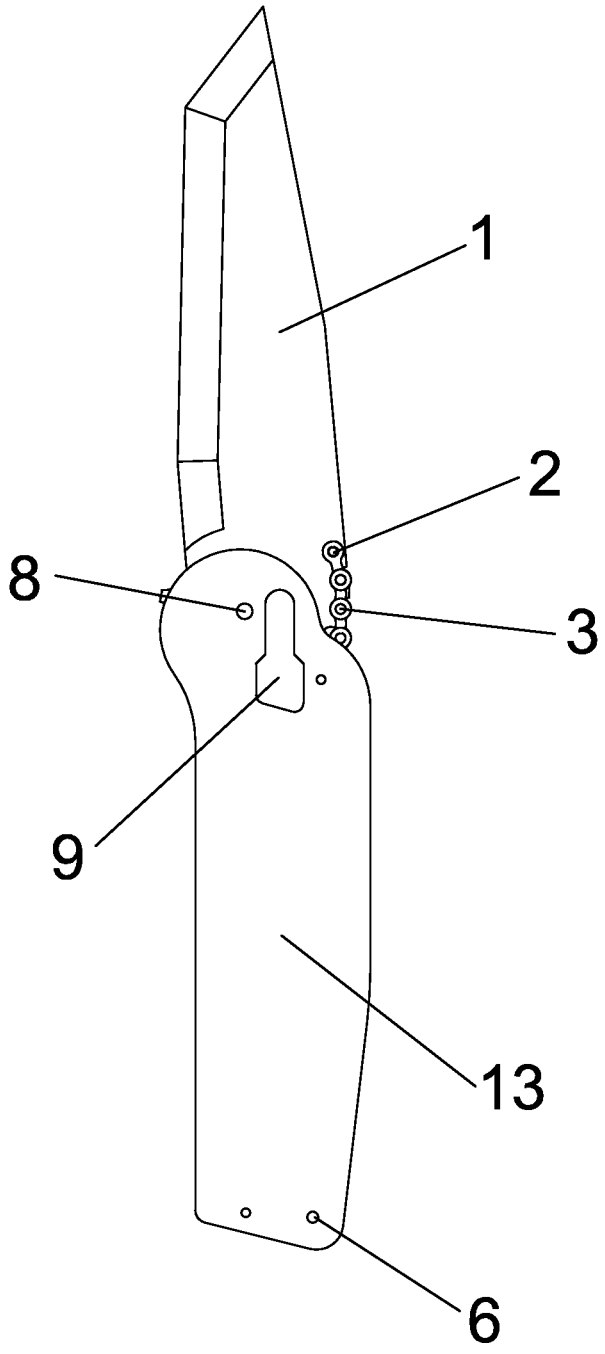
FIG. 1E is a left side view of the assembled knife with the blade deployed in the extended position.
Figure 1F:
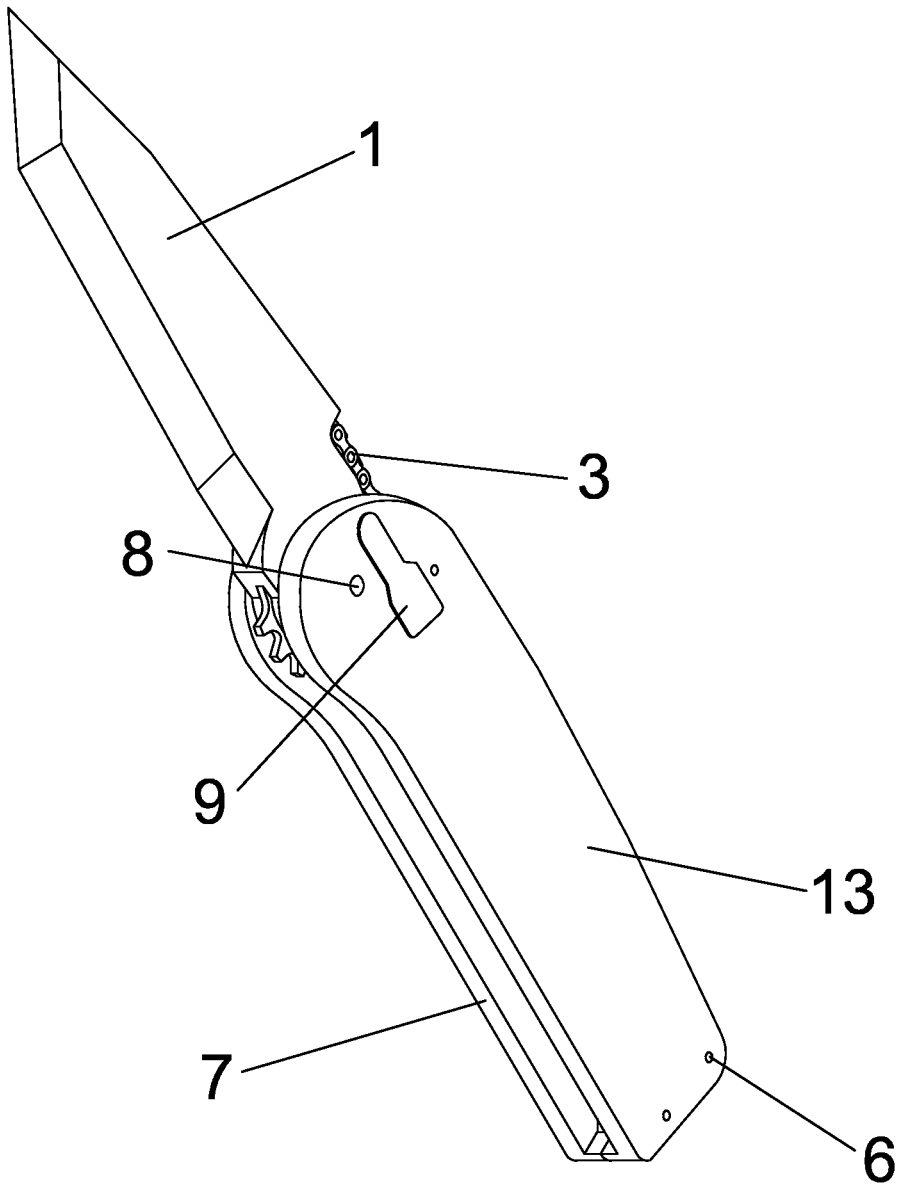
FIG. 1F is a perspective of the knife fully assembled with the blade deployed in the extended position.

One embodiment of the knife is shown in FIG. 1A, FIG. 1B, FIG. 1C, FIG. 1D, FIG. 1E, and FIG. 1F. Knife blade 1 is attached to right side of knife handle 7 and left side of knife handle 13 by an axle pin 8 which allows the blade to rotate between the folded position shown in FIG. 1A and the extended position shown in FIG. 1B, FIG. 1C, FIG. 1D, and FIG. 1E. The Knife blade 1 is attached to a flexible tendon in the form of a chain 3 via a pin 2 and the opposite end of the flexible tendon in the form of a chain 3 is attached to a tension spring 5 via a separate pin 4. The opposite end of the tension spring 5 is attached to the handle via another pin 6. When the knife blade 1 is in the folded position as shown in FIG. 1A the blade release catch 9 is forced by the blade release catch spring 12 into the enlarged end of the radial slot in blade 10 which keeps the blade locked in the folded position. When the blade is extended as shown in FIG. 1B the blade rotation stop pin 11 stops the rotation at a predetermined angle which allows the blade release catch to be forced into the enlarged slot at the opposite end of the radial slot in blade 10 by the blade release catch spring 12 which locks the blade in the open position.

Operation

In operation the blade 39 is in the folded position with force from the tension spring 5 being applied to the blade via the flexible tendon in the form of a chain 3 and the force being resisted by blade release catch 9 engaging in an enlarged slot in the handle. The blade release catch is held in the blade lock position by pressure applied to it via the blade release catch spring 12. When the blade release 9 is depressed and the spring pressure overcome the knife blade 1 is free to move about axis pin 8 and the potential energy in tension spring 5 is applied via flexible tendon in the form of a chain 3 to the blade thus rotating it into the extended position.

Advantages

From the description above, a number of advantages of some embodiments of my folding knife design become evident:

(a) The size, shape, and length of the blade is not limited by the size of spring that can fit in the handle at the axle pin location of the folding blade.

(b) The tension spring is completely concealed in the handle (c) The flexible tendon can be of a more durable material than the spring (d) The flexible tendon can be of a more visually appealing material than the spring (e) The use of a flexible tendon allows the force of the spring to be applied to the folding blade for a longer distance and duration than directly connecting the spring when the spring is concealed.

CONCLUSION, RAMIFICATIONS, AND SCOPE

Thus the reader will see at least one embodiment of the knife allows for the use of a blade of larger size, weight, and length than by mechanisms previously used in other knife designs. Additionally, in at least one embodiment of the knife the use of a flexible tendon allows the tension spring to be concealed and protected from the environment, and the use of a flexible tendon allows mounting at a position on the blade that will generate a greater moment arm than a conventional torsion spring design will allow.

While my above description contains many specificities, these should not construed as limitations on the scope, but rather as an exemplification of one preferred embodiment thereof. Many other variations are possible, for example a locking mechanism that uses a hinge pin to rotated the lock out of the radial slot and locking notch, or the use of a notch on the outside of the gear face that has a spring loaded lever holding the blade in the folded position. Additional variations in the flexible tendon material beyond chain are possible, for example the use of a metal solid wire or wound cable, or even the use of a molded or machined polymer. Additional variations in the design of the grip could include for example a one piece assembly instead of two halves.

Accordingly, the scope should be determined not by the embodiment illustrated, but by the appended claims and their legal equivalents.

The invention claimed is:

1. A folding knife comprising:

A handle;

a tension spring having one end pinned to the handle;

a flexible chain having one end pinned to an opposite end of the tension spring;

a rotatable blade which rotates upon an axle pin from a folded position to an extended position, wherein an opposite end of the flexible chain is pinned to the rotatable blade at a distance from a rotational axis of the blade thus creating a moment arm; and a release mechanism for the rotatable blade, whereby pressing the release mechanism for the rotatable blade allows energy stored in the tension spring to be applied to the rotatable blade through the flexible chain, thus causing the blade to rotate from the folded position to the extended position.

* * * * *